US007161103B1

(12) United States Patent
Karaki et al.

(10) Patent No.: US 7,161,103 B1
(45) Date of Patent: Jan. 9, 2007

(54) MOVEABLE CONTACT ASSEMBLY, METHOD OF MANUFACTURING THE SAME, AND SWITCH USING THE SAME

(75) Inventors: Minoru Karaki, Okayama (JP); Makoto Sadakane, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/447,135

(22) Filed: Jun. 6, 2006

(30) Foreign Application Priority Data

Jul. 1, 2005 (JP) ..... 2005-193376

(51) Int. Cl.
*H01H 1/02* (2006.01)

(52) U.S. Cl. ..... 200/262; 200/265; 200/534

(58) Field of Classification Search ..... 200/262–269, 200/502, 534
See application file for complete search history.

(56) References Cited

U.S. PATENT DOCUMENTS 5,422,451 A * 6/1995 Herklotz ..... 200/269
5,500,499 A * 3/1996 Seki et al. ..... 218/130
5,860,513 A * 1/1999 Suzuki ..... 200/268
5,892,424 A * 4/1999 Yamamoto et al. ..... 335/151
6,437,266 B1 * 8/2002 Pannenborg et al. ..... 200/262

FOREIGN PATENT DOCUMENTS

JP 11-232963 8/1999

* cited by examiner

*Primary Examiner*—K. Lee
(74) *Attorney, Agent, or Firm*—Wenderoth, Lind & Ponack, L.L.P.

(57) ABSTRACT

A movable contact assembly includes a base sheet made of insulating film, a contact provided under a bottom surface of the base sheet, and a conductive layer comprising silver paste on the base sheet. The silver paste contains 12 wt % to 15 wt % of resin binder and 35 wt % to 88 wt % of silver particles. The resin binder includes polyester resin having a glass-transition point ranging from 30° C. to 40° C. and an average molecular weight ranging from 30000 to 35000. The silver particles contain 70 wt % to 80 wt % of flake-shaped silver particles and 20 wt % to 30 wt % of dendritic silver particles. This conductive layer of the movable contact assembly can be baked at a low temperature, and does not have cracks and is not peeled off even when being bent. In addition, this conductive layer can easily cope with static electricity and has high reliability.

5 Claims, 7 Drawing Sheets

Fig. 6

| Sample No. | Polyester Resin | | Silver Particles | | | Diluting Solvent | | Sheet Resistance (Ω/□) | Changing Rate of Resistance (%) |
|---|---|---|---|---|---|---|---|---|---|
| | Glass-Transition Point (°C) | Average Molecular Weight | Flake-Shaped Particles (wt%) | Dendritic Particles (wt%) | Amount in Ag Paste (wt%) | BCA (wt%) | Isophorone (wt%) | | |
| 1 | 30-40 | 30000-35000 | 80 | 20 | 85 | 90 | 10 | 0.05 | 25 |
| 2 | 20-30 | 30000-35000 | 80 | 20 | 85 | 90 | 10 | 0.05 | 215 |
| 3 | 40-50 | 30000-35000 | 80 | 20 | 85 | 90 | 10 | 0.05 | 314 |
| 4 | 30-40 | 25000-30000 | 80 | 20 | 85 | 90 | 10 | 0.04 | 258 |
| 5 | 30-40 | 35000-40000 | 80 | 20 | 85 | 90 | 10 | 0.06 | 162 |
| 6 | 30-40 | 35000-40000 | 90 | 10 | 85 | 90 | 10 | 0.04 | 178 |
| 7 | 30-40 | 30000-35000 | 70 | 30 | 85 | 90 | 10 | 0.06 | 29 |
| 8 | 30-40 | 30000-35000 | 65 | 35 | 85 | 90 | 10 | 0.10 | 98 |
| 9 | 30-40 | 30000-35000 | 80 | 20 | 80 | 90 | 10 | 0.11 | 211 |
| 10 | 30-40 | 30000-35000 | 80 | 20 | 88 | 90 | 10 | 0.04 | 32 |
| 11 | 30-40 | 30000-35000 | 80 | 20 | 90 | 90 | 10 | 0.03 | 158 |
| 12 | 30-40 | 30000-35000 | 80 | 20 | 85 | 85 | 15 | 0.12 | 89 |
| 13 | 30-40 | 30000-35000 | 80 | 20 | 85 | 95 | 5 | 0.04 | 23 |

Fig. 7 – PRIOR ART
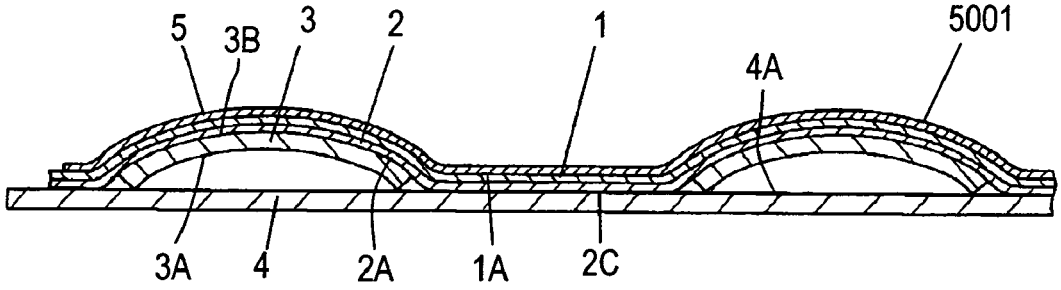
Fig. 8 – PRIOR ART
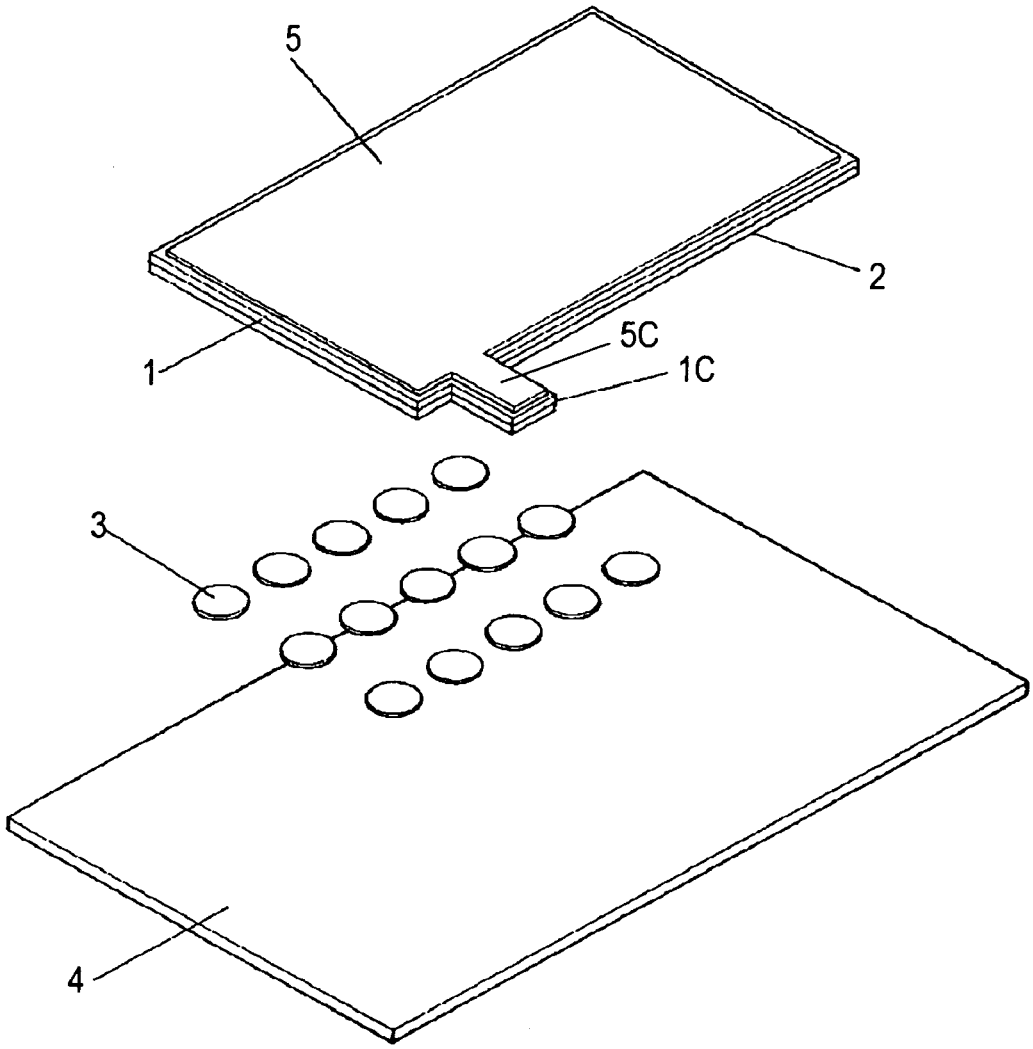

Fig. 9 – PRIOR ART
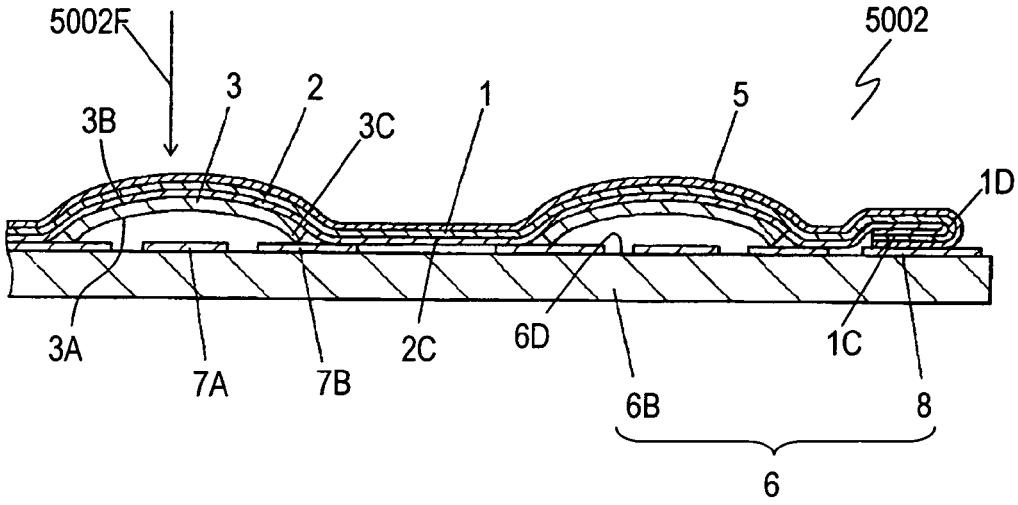

MOVEABLE CONTACT ASSEMBLY, METHOD OF MANUFACTURING THE SAME, AND SWITCH USING THE SAME

FIELD OF THE INVENTION

The present invention relates to a switch, such as an operation panel of various electric devices, a movable contact assembly used in the switch, and a method of manufacturing the movable contact assembly.

BACKGROUND OF THE INVENTION

Portable electronic devices, such as portable phones or Portable Data Arrays (PDA), have been widely used, and had measures against static electricity put into. In order to design a circuit board easily, panel switches used as operation panels are provided with measures against static electricity.

Such panel switch includes movably contact assembly in which a movable contact made of elastic conductive metal processed to have a dome shape is held under an insulating film. This panel switch provides its operation with fine feeling, and provides electrically stable switching characteristics.

FIG. 7 is a sectional view of conventional movable contact assembly 5001 used for a panel switch disclosed in Japanese Patent Laid-Open Publication No. 11-232963. FIG. 8 is an exploded perspective view of movable contact assembly 5001. FIG. 9 is a sectional view of panel switch 5002 including movable contact assembly 5001.

Adhesive layer 2 is provided entirely on bottom surface 1A of flexible base sheet 1 made of insulating film, such as polyethylene terephthalate (PET). Movable contacts 3 electrically independent from each other are held on bottom surface 2A of adhesive layer 2. Movable contact 3 is made of elastic conductive metal processed to have a dome shape, and has concave surface 3A and convex surface 3B. Convex surface 3B of movable contact 3 is held at bottom surface 2A of adhesive layer 2. Conductive layer 5 is formed on upper surface 1B of base sheet 1. Conductive layer 5 is formed by printing and baking silver paste at 120° C. for 10 minutes. Separator 4 made of insulating film has surface 4A processed to be removable. Separator 4 is bonded onto portion 2C of adhesive layer on which movable contact 3 is not provided, thus positioning movable contact 3 between adhesive layer 2 and separator 4.

When movable contact assembly 5001 is used, as shown in FIG. 9, separator 4 is peeled off from adhesive layer 2, and portion 2C of bottom surface 2A of adhesive layer 2 is bonded onto surface 6A of circuit board 6. Circuit board 6 includes insulating board 6B and fixed contacts 7A and 7B provided on surface 6D of insulating board 6B. Surface 6A of circuit board 6 includes surface 6D of insulating board 6B and surfaces 7C and 7B of fixed contacts 7A and 7B. Portion 2C of bottom surface 2A of adhesive layer 2 is bonded onto fixed contact 7B and surface 6D. Fixed contact 7A faces concave surface 3A of movable contact 3. Outer periphery 7C of movable contact 3 is placed on fixed contact 7B. Movable contact 3 and fixed contacts 7A and 7B function as switch contacts.

An operation of panel switch 5002 will be described below. Force 5002F is applied from above upper surface 1B of base sheet 1 down toward movable contact 3 to reverse the dome shape of movable contact 3 elastically. Then, concave surface 3A of movable contact 3 contacts fixed contact 7A, thus connecting fixed contact 7A electrically with fixed contact 7B via movable contact 3.

Then, when force 5002F is removed, movable contact 3 returns to its original dome shape by its own elastic restoring force, and disconnects fixed contact 7A electrically from fixed contact 7B.

Base sheet 1 includes tongue portion 1C protruding therefrom. Conductive layer 5 has portion 5C formed on tongue portion 1C of base sheet 1. Tongue portion 1C is folded by 180 degrees at portion 1D and is bonded, so that portion 5C of conductive layer 5 contacts land 8 for grounding provided on insulating board 6B. Static electricity flowing from a human body to movable contact assembly 5001 via an operation button (not shown) flows into a ground via portion 5C of conductive layer 5 and land 8. This structure allows panel switch 5002 to have a small size.

Conductive layer 5 is formed by printing silver paste on base sheet 1 and baking the paste at a high temperature ranging from 120° C. to 150° C. for 10 minutes. This high temperature may cause base sheet 1 to deform, and increases energy cost to generate the high temperature.

The silver paste for forming conductive layer 5 may not be baked sufficiently in a temperature lower than the above temperature, and consequently, may cause conductive layer 5 to have cracks at portion 1D of base sheet 1 or to be peeled off from base sheet 1.

SUMMERY OF THE INVENTION

A movable contact assembly includes a base sheet made of insulating film, a contact provided under a bottom surface of the base sheet, and a conductive layer comprising silver paste on the base sheet. The silver paste contains 12 wt % to 15 wt % of resin binder and 35 wt % to 88 wt % of silver particles. The resin binder includes polyester resin having a glass-transition point ranging from 30° C. to 40° C. and an average molecular weight ranging from 30000 to 35000. The silver particles contain 70 wt % to 80 wt % of flake-shaped silver particles and 20 wt % to 30 wt % of dendritic silver particles.

This conductive layer of the movable contact assembly can be baked at a low temperature, does not have cracks, and is not peeled off even when being bent. In addition, this conductive layer can easily cope with static electricity and has high reliability.

BRIEF DESCRIPTION OF THE DRAWINGS

FIG. 6 shows an evaluation result of the movable contact assembly in accordance with the embodiment.

FIG. 7 is a sectional view of a conventional movable contact assembly.

FIG. 8 is an exploded perspective view of the conventional movable contact assembly.

FIG. 9 is a sectional view of a conventional switch.

DETAILED DESCRIPTION OF THE INVENTION

Figure 1:
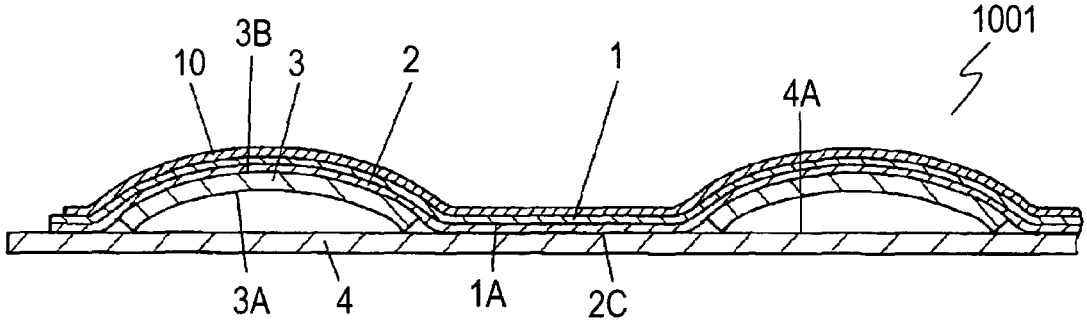
FIG. 1 is a sectional view of a movable contact assembly in accordance with an exemplary embodiment of the present invention.
Figure 2:
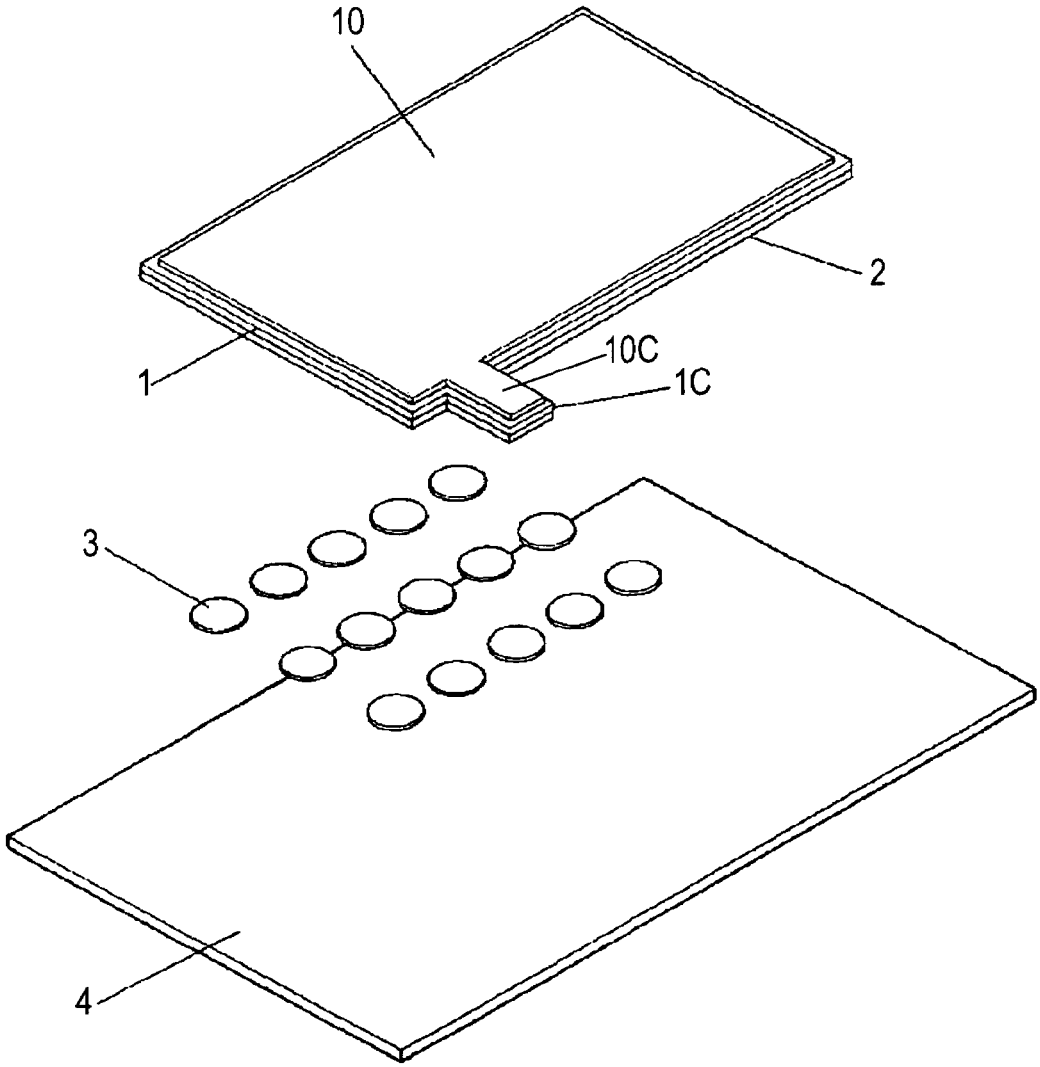
FIG. 2 is an exploded perspective view of the movable contact assembly in accordance with the embodiment.
Figure 3:
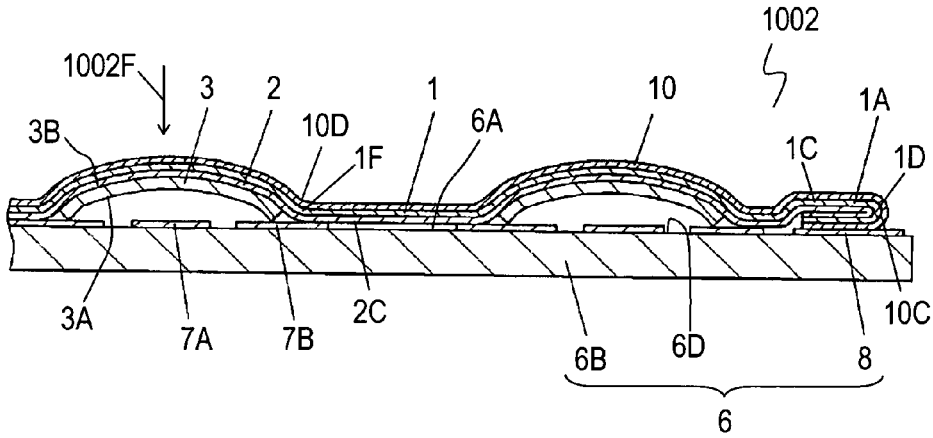
FIG. 3 is a sectional view of a switch in accordance with the embodiment.

FIG. 1 is a sectional view of movable contact assembly 1001 used for a panel switch in accordance with an exemplary embodiment of the present invention. FIG. 2 is an exploded perspective view of movable contact assembly 1001. FIG. 3 is a sectional view of panel switch 1002 including movable contact assembly 1001.

Adhesive layer 2 is provided entirely on bottom surface 1A of flexible base sheet 1 made of insulating film, such as polyethylene terephthalate (PET). Base sheet has upper surface 1B opposite to bottom surface 1A. Movable contacts 3 electrically independent from each other are held at bottom surface 2A of adhesive layer 2. Movable contact 3 is made of elastic conductive metal processed to have a dome shape, and has concave surface 3A and convex surface 3B opposite to concave surface 3A. Convex surface 3B of movable contact 3 is held on bottom surface 2A of adhesive layer 2. Conductive layer 10 is formed on upper surface 1B of base sheet 1. Conductive layer 10 is formed by printing silver paste and then baking the silver paste at 120° C. for 10 minutes. Separator 4 made of insulating film has surface 4A processed to be removable. Separator 4 is bonded onto portion 2C of adhesive layer on which movable contact 3 is not provided, thus positioning movable contact 3 between adhesive layer 2 and separator 4.

When movable contact assembly 1001 is used, as shown in FIG. 9, separator 4 is peeled off from adhesive layer 2, and portion 2C of bottom surface 2A of adhesive layer 2 is bonded onto surface 6A of circuit board 6. Circuit board 6 includes insulating board 6B and fixed contacts 7A and 7B provided on surface 6D of insulating board 6B. Surface 6A of circuit board 6 includes surface 6D of insulating board 6B and surfaces 7C and 7B of fixed contacts 7A and 7B. Portion 2C of bottom surface 2A of adhesive layer 2 is bonded onto fixed contact 7B and surface 6D. Fixed contact 7A faces concave surface 3A of movable contact 3. Outer periphery 7C of movable contact 3 is located on fixed contact 7B. Movable contact 3 and fixed contacts 7A and 7B function as switch contacts.

An operation of panel switch 1002 will be described below. Force 1002F is applied from above upper surface 1B of base sheet 1 toward movable contact 3 to reverse the dome shape of movable contact 3 elastically. Then, concave surface 3A of movable contact 3 contacts fixed contact 7A, thus connecting fixed contact 7A electrically with fixed contact 7B via movable contact 3.

Then, when force 1002F is removed, movable contact 3 returns to its original dome shape by its own elastic restoring force, and disconnects fixed contact 7A electrically from fixed contact 7B.

Base sheet 1 has tongue portion 1C protruding therefrom. Conductive layer 10 has portion 10C formed on tongue portion 1C of base sheet 1. Tongue portion 1C is folded by 180 degrees at portion 1D and is bonded, so that portion 10C of conductive layer 10 contacts land 8 for grounding provided on insulating board 6B. Static electricity flowing from a human body to movable contact assembly 1001 via an operation button (not shown) flows into a ground via portion 10C of conductive layer 10 and land 8. This structure allows panel switch 1002 to have a small size.

Samples of the silver paste for forming conductive layer 10 were prepared and evaluated.

Figure 4A:
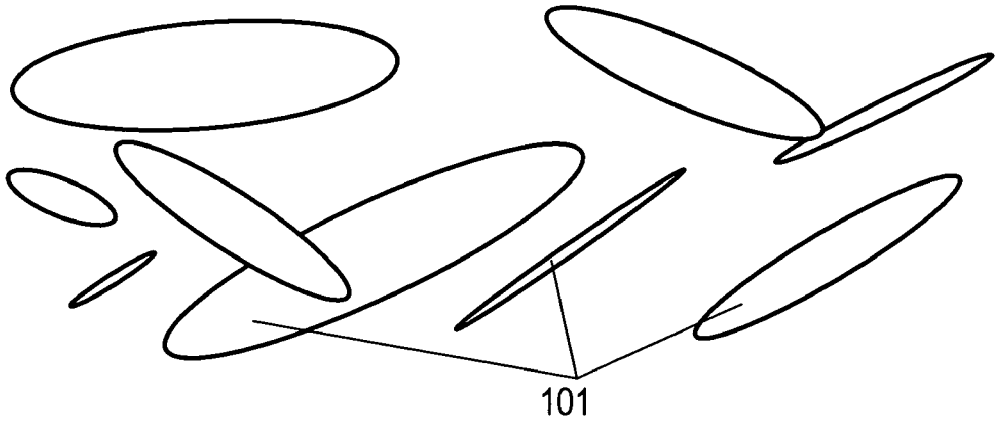
FIGS. 4A and 4B are exploded perspective views of flake-shaped silver particles and dendritic silver particles used in the movable contact assembly in accordance with the embodiment.
Figure 4B:
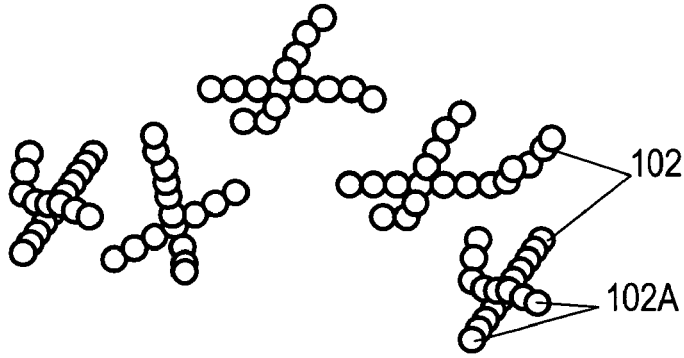

Resin binder made of varnish-type polyester resin having a glass-transition point ranging from 30° C. to 40° C. and an average molecular weight ranging from 30000 to 35000 was prepared. Silver particles including 80 wt % of flake-shaped silver particles 101 and 20 wt % of dendritic silver particles 102 of 20 wt % mixed therein were prepared. FIGS. 4A and 4B are exploded perspective views of flake-shaped silver particles 101 and dendritic silver particles 102. Dendritic silver particles 102 are made of spherical silver particles 102A coupled with each other. The resin binder and the silver particles were mixed and agitated for 15 minutes with a universal agitator, and were milled for 30 minutes with a triple-roll mill, thus providing initial silver paste containing 15 wt % of polyester resin binder and 85 wt % of the silver particles.

The initial silver paste was mixed with 20 wt % to 30 wt % of diluting solvent in order to prepare silver paste having a viscosity appropriate for screen-printing. This diluting solvent contains 90 wt % of Butyl Cellosolve Acetate (BCA) and 10 w % of isophorone.

This silver paste is screen-printed on upper surface 1B of base sheet 1 made of PET film having a thickness of 50 μm through a stainless mask having a thickness of 10 μm and 300 mesh. The printed silver paste is baked at 80° C. for 5 minutes in a hot-air circulating reactor with far-infrared radiation as to have the diluting solvent volatilized to form conductive layer 10, thus providing sample No. 1.

Samples Nos. 2 and 3 were prepared, similarly to the sample No. 1, with using resin binder made of polyester resins having glass-transition points different from that of the sample No. 1. The glass-transition point of the polyester resin of the sample No. 2 ranged from 20° C. to 30° C., which was lower than that of the sample No. 1. The glass-transition point of the polyester resin of the sample No. 3 ranged from 40° C. to 50° C., which was higher than that of the sample No. 1.

Samples Nos. 4 and 5 were prepared with using resin binder made of polyester resins having average molecular weights different from that of the sample No. 1. The glass-transition points of the polyester resins of the samples 4 and 5 were identical to the glass-transition point of the sample No. 1. The average molecular weight of the polyester resin of the sample No. 4 ranged from 25000 to 30000, which was smaller than that of the sample No. 1. The average molecular weight of the polyester resin of the sample No. 5 ranged from 35000 to 40000, which was larger than that of the sample No. 1.

Samples Nos. 6 to 8 were prepared with using silver paste including silver particles containing flake-shaped silver particles and dendritic silver particles at ratios different from each other. The mixture ratio of the flake-shaped silver particles in the silver particles of the silver paste of the sample No. 6 was 90 wt %, which was larger than that of the sample No. 1. The mixture ratio of the flake-shaped silver particles in the silver particles of the silver paste of the sample No. 7 was 70 wt %, which was smaller than that of the sample No. 1. The mixture ratio of the flake-shaped silver particles in the silver particles of the silver paste of the sample No. 8 was 65 wt %, which was further smaller than that of the sample No. 1.

Samples Nos. 9 to 11 having mixture ratios of the silver particles different from each other were prepared. The mixture ratio of the silver particles in the silver paste of the sample No. 9 was 80 wt %, which was smaller than that of the sample No. 1. The mixture ratio of the silver particles in the silver paste of the sample No. 10 was 88 wt %, which was larger than that of the sample No. 1. The mixture ratio of the silver particles in the silver paste of the sample No. 11 was 90 wt %, which was further larger than that of the sample No. 1.

Samples Nos. 12 and 13 were prepared with using the diluting solvent having mixture ratios of Butyl Cellosolve Acetate (BCA) and isophorone different from each other. The mixture ratio of BCA in the diluting solvent of the silver paste of the sample No. 12 was 85 wt %, which was smaller than that of the sample No. 1. The mixture ratio of BCA in the diluting solvent of the silver paste of the sample No. 13 was 95 wt %, which was larger than that of the sample No. 1. The mixture ratio of the diluting solvent in the silver paste of each of the samples Nos. 12 and 13 ranged from 20 wt % to 30 wt %, which was identical to that of the sample No. 1 to provide the silvwer paste with a viscosity appropriate for screen-printing.

Silver paste was prepared with using diluting solvent containing more than 95 wt % of BCA. This diluting solvent has a large volatility, hence changing the viscosity of the silver paste during the screen-printing. This change on the viscosity prevented the silver paste from being applied well, not providing conductive layer 10 formed precisely.

Figure 5:
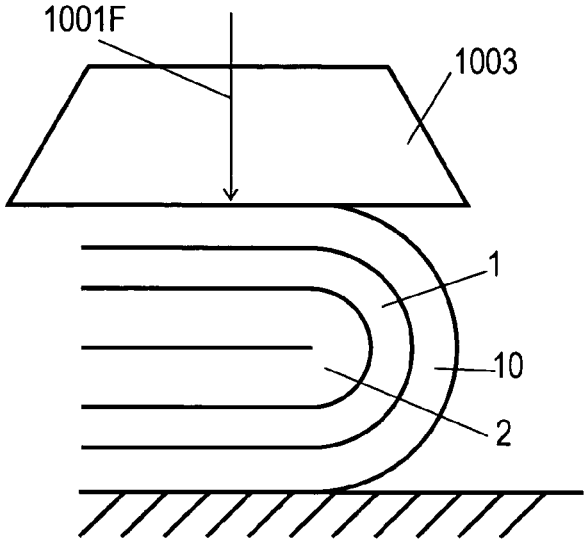
FIG. 5 is a sectional view of the movable contact assembly for illustrating a method of evaluating the assembly in accordance with the embodiment.

FIG. 5 is a sectional view of movable contact assembly 1001 for illustrating a method of evaluating the assembly. Base sheet 1 was bent by 180 degrees at portion 1E as to position conductive layer 10 outside, and a pressure 1001F of 12 kPa was applied to the layer via truncated cone 1003 for three seconds. Then, bent portion 1E was forced returning to have its original unbent shape. This process was repeated ten times. The change of the electrical resistance between two positions placed across bent portion 1E was measured. A resistance per unit volume (i.e. a sheet resistance) of conductive layer 10 was measured before the bending by 180 degrees of base sheet 1. Compositions of the samples Nos. 1 to 13 and their evaluation results are shown in FIG. 6.

As shown in FIG. 6, the samples Nos. 1, 7, 10, and 13 exhibited small sheet resistances, 0.04 Ω/□ to 0.06 Ω/□, and small changing rates 23% to 32%, of the resistances after the bending.

The sample No. 2 with resin binder made of polyester resin having a low glass-transition point of 20° C. to 30° C. exhibited a small sheet resistance of 0.05 Ω/□, however, exhibited a large changing rate of 215% of the resistance after the bending. Sample No. 3 with resin binder made of polyester resin having a high glass-transition point of 40° C. to 50° C. exhibited a sheet resistance as small as that of sample No. 2, however, exhibited a large changing rate of 314% of the resistance after the bending.

Sample No. 4 with polyester resin having the small average molecular weight of 25000 to 30000 exhibited a large changing rate of 258% of the resistance after the bending. Sample No. 5 with polyester resin having the average molecular weight of 35000 to 40000 exhibited a large changing rate of 162% of the resistance after the bending.

A reason for providing the large changing rates of the resistance after the bending is estimated as that the change of the glass-transition point or the average molecular weight may decrease the strength of conductive layer 10, hence allowing the bending to break inside of conductive layer 10 and to break a conductive path.

Sample No. 6 with the silver particles containing 90 wt % of the flake-shaped silver particles exhibited a relatively small sheet resistance of 0.04 Ω/□, however, exhibited a large changing rate of 178% of the resistance after the bending. Sample No. 8 with the silver particles containing 65 wt % of the flake-shaped silver particles exhibited a little large sheet resistance of 0.10 Ω/□, and exhibited a relatively large changing rate of 88% of the resistance after the bending.

A reason for the variation of the changing rates of the resistances due to the mixture ratio of the flake-shaped silver particles and the dendritic silver particles is estimated as that two kinds of the silver particles do not contact each other sufficiently while increasing or decreasing the flake-shaped silver particles.

Sample No. 9 having the small mixture ratio, 80 wt %, of the silver particles in the silver paste exhibited a large sheet resistance of 0.11 Ω/□, and exhibited a large changing rate of 211% of the resistance after the bending. Sample No. 11 having the large mixture ratio, 90 wt %, of the silver particles in the silver paste exhibited a small sheet resistance of 0.03 Ω/□, however, exhibited a large changing rate of 158% of the resistance after the bending.

A reason for the variation of the changing rates of the resistances due to the mixture ratio of the silver particles in the silver paste is considered as follows. As shown in sample No. 9, a small amount of the silver particles in the silver paste decreases an electrical conductivity, accordingly increasing the sheet resistance.

As shown for sample No. 11, a large amount of the silver particles in the silver paste increases an electrical conductivity without the bending. however, makes conductive layer 10 brittle. Thus, it is estimated that this situation may cause a conductive path to break at bent portion 1E, thus increasing the resistance after the bending.

Sample No. 12 prepared with using the diluting solvent having the small mixture ratio of BCA exhibited a large sheet resistance, 0.12 Ω/□ and a relatively large changing rate of 89% of the resistance after the bending. A reason for this result is estimated as follows. The large mixture ratio of isophorone raises a boiling point of the diluting solvent, accordingly preventing the solvent from being volatilized sufficiently and causing the diluting solvent to remain in conductive layer 10 even after the baking.

The results shown in FIG. 6 provide the following conclusion. The resin binder made of varnish-type polyester resin preferably has a glass-transition point ranging from 30° C. to 40° C. and a average molecular weight ranging from 30000 to 35000. The silver particles to be mixed into the resin binder are preferably produced by mixing 70 wt % to 80 wt % of flake-shaped silver particles and 20 wt % to 30 wt % of dendritic silver particles. The initial silver paste is preferably prepared by milling 2 wt % to 15 wt % of the resin binder and 85 wt % to 88 wt % of the silver particles. The diluting solvent containing 90 wt % to 95 wt % of Butyl Cellosolve Acetate and 5 wt % to 10 wt % of isophorone is prepared. 80 wt % to 70 wt % of the initial silver paste and 20 wt % to 30 wt % of the diluting solvent are milled to provide the silver paste having a viscosity appropriate for screen-printing. The silver paste is screen-printed on upper surface 1B of base sheet 1 and baked at 80° C. for five minutes, thereby forming conductive layer 10. Conductive layer 10 has a large hardness, a large strength, and a large flexibility. Even if base sheet 1 is bent by 180 degrees to position conductive layer 10 outside, conductive layer 10 can hardly have cracks and hardly peeled off, thus providing conductive layer 10 with a high reliability. The above silver paste can be screen-printed easily and precisely, and baked at a low temperature for a short time, accordingly reduce energy cost.

As shown in FIG. 3, portion 1F of base sheet 1 over outer periphery 3C of movable contact 3 is bent and expands repetitively whenever switch 1002 is activated. Upper surface 10D of base sheet 1F of conductive layer 10 is also bent and expands as repetitively as portion 1F. Even if being bent and expanding repetitively, conductive layer 10 according to the embodiment can hardly be peeled off from base sheet 1 and hardly have its inside broken, thus providing switch 1002 with a long life and a high reliability.

The above silver paste is baked at 80° C. for five minutes, however, may be baked at 80° C.±10° C. for 3 to 10 minutes, thus providing the same effects. The silver paste is baked preferably at 80° C.±5° C. for 5 min ±1 min. This baking temperature may be determined to be higher than the above temperature unless base sheet 1 deforms, however, can not reduce an energy cost.

Tongue portion 1C provided at base sheet 1 is bent by 180 degrees to allow conductive layer 10 to contact land 8 for grounding of circuit board 6. This structure causes a static electricity flowing into conductive layer 10 to escape to a grounding circuit. Thus, conductive layer 10 of movable contact assembly 1001 can easily cope with the static electricity and has a high reliability. Panel switch 1002 including movable contact assembly 1001 can be used in an operation panel which may receive a static electricity flowing therein, of various electronic devices.

Movable contact assembly 1001 of the embodiment can be used in an electronic device including an operation unit receiving a static electricity flowing therein as well as panel switch 1002.

What is claimed is:

1. A movable contact assembly comprising:

a base sheet made of insulating film having an upper surface and a bottom surface;

a contact provided under the bottom surface of the base sheet; and a conductive layer comprising silver paste on the upper surface of the base sheet, wherein the silver paste contains 12 wt % to 15 wt % of resin binder and 85 wt % to 88 wt % of silver particles, the resin binder comprises polyester resin having a glass-transition point ranging from 30° C. to 40° C. and an average molecular weight ranging from 30000 to 35000, and the silver particles contain 70 wt % to 80 wt % of flake-shaped silver particles and 20 wt % to 30 wt % of dendritic silver particles.

2. A switch comprising:

a base sheet made of insulating film having an upper surface and a bottom surface;

a first contact provided under the bottom surface of the base sheet;

a conductive layer comprising silver paste on the upper surface of the base sheet; and a second contact facing the first contact, wherein the silver paste contains 12 wt % to 15 wt % of resin binder and 85 wt % to 88 wt % of silver particles, the resin binder comprises polyester resin having a glass-transition point ranging from 30° C. to 40° C. and an average molecular weight ranging from 30000 to 35000, and the silver particles contain 70 wt % to 80 wt % of flake-shaped silver particles and 20 wt % to 30 wt % of dendritic silver particles.

3. The switch of claim 2, wherein the base sheet has a portion bent, and the conductive layer has a portion provided on the portion of the base sheet.

4. A method for manufacturing a movable contact assembly, comprising:

providing polyester resin having a glass-transition point ranging from 30° C. to 40° C. and an average molecular weight ranging from 30000 to 35000;

providing silver particles containing 70 wt % to 80 wt % of flake-shaped silver particles and 20 wt % to 30 wt % of dendritic silver particles;

providing diluting solvent containing 90 wt % to 95 wt % of butyl cellosolve acetate and 5 wt % to 10 wt % of isophorone;

preparing initial silver paste by mixing 12 wt % to 15 wt % of the polyester resin with 85 wt % to 88 wt % of the silver particles;

preparing silver paste by mixing 20 wt % to 30 wt % of the diluting solvent with 80 wt % to 70 wt % of the initial silver paste;

applying the silver paste on an upper surface of a base sheet;

baking the applied silver paste; and providing a contact under a bottom surface of the base sheet.

5. The method of claim 4, wherein said applying of the silver paste on the upper surface of the base sheet comprises screen-printing the silver paste on the upper surface of the base sheet.

* * * * *